US005217746A

United States Patent [19]

Lenling et al.

[11] Patent Number: 5,217,746

[45] Date of Patent: Jun. 8, 1993

[54] METHOD FOR MINIMIZING DECARBURIZATION AND OTHER HIGH TEMPERATURE OXYGEN REACTIONS IN A PLASMA SPRAYED MATERIAL

[75] Inventors: William J. Lenling, Madison, Wis.; Joseph A. Henfling, Bosque Farms; Mark F. Smith, Albuquerque, both of N. Mex.

[73] Assignee: Fisher-Barton Inc., Watertown, Wis.

[21] Appl. No.: 627,060

[22] Filed: Dec. 13, 1990

[51] Int. Cl.[5] ..... B05D 1/00; B05D 3/02

[52] U.S. Cl. ..... 427/450; 427/190; 427/191

[58] Field of Search ..... 427/34, 423, 190, 191

[56] References Cited

U.S. PATENT DOCUMENTS

| | | | |
|---|---|---|---|
| 3,640,757 | 2/1972 | Grubba | 427/34 |
| 3,896,244 | 7/1975 | Ellis et al. | 427/34 |
| 4,386,112 | 5/1983 | Eaton et al. | 427/34 |
| 4,481,237 | 11/1984 | Bosshart et al. | 427/34 |
| 4,621,183 | 11/1986 | Takeuchi et al. | 427/34 |
| 4,681,772 | 7/1987 | Rairden, III | 427/34 |
| 5,075,129 | 12/1991 | Jackson et al. | 427/34 |

OTHER PUBLICATIONS

Enhanced Abrasion/Erosion Resistance of Agricultural Knives by Austemper Assisted Bonding of Thermal Spray Coatings by James L. McAfee et al., pp. 137–142 no date, no source.

Tungsten carbide phase transformation during the plasma spray process by D. Tu et al., p. 2,479 of the *J. Vac. Sci. Technol.* A 3(6), Nov./Dec. 1985.

Metallurigcal Characterization of Plazma Sprayed WC–CO Coatings by S. Rangaswamy et al., pp. 101–110 *Advances in Thermal Spraying.*

Plasma Spraying by R. F. Smart, pp. 11–39. Crane, Russak & Co., Inc., New York, N.Y. no date given.

Thermal Spray Coatings by James H. Clare et al., Metals Handbook Ninth Edition, vol. 5, pp. 361–374 no date given.

*Primary Examiner*—Marianne Padgett

*Attorney, Agent, or Firm*—Lathrop & Clark

[57] ABSTRACT

A method is disclosed for spray coating material which employs a plasma gun that has a cathode, an anode, an arc gas inlet, a first powder injection port, and a second powder injection port. A suitable arc gas is introduced through the arc gas inlet, and ionization of the arc gas between the cathode and the anode forms a plasma. The plasma is directed to emenate from an open-ended chamber defined by the boundary of the anode. A coating is deposited upon a base metal part by suspending a binder powder within a carrier gas that is fed into the plasma through the first powder injection port; a material subject to degradation by high temperature oxygen reactions is suspended within a carrier gas that is fed into the plasma through the second injection port. The material fed through the second injection port experiences a cooler portion of the plasma and has a shorter dwell time within the plasma to minimize high temperature oxygen reactions. The material of the first port and the material of the second port intermingle within the plasma to form a uniform coating having constituent percentages related to the powder-feed rates of the materials through the respective ports.

6 Claims, 2 Drawing Sheets

METHOD FOR MINIMIZING DECARBURIZATION AND OTHER HIGH TEMPERATURE OXYGEN REACTIONS IN A PLASMA SPRAYED MATERIAL

This invention was made in performance of work under United States Department of Energy Contract No. 05-0957 and the United States Government may have certain rights in the invention.

FIELD OF THE INVENTION

This invention relates to a method of producing thermal spray coatings that are deposited upon base metal parts by plasma guns, often to improve the wear resistance on the surface of the parts.

BACKGROUND OF THE INVENTION

Thermal spray coatings are used in a wide variety of industrial applications. Such coatings are often of materials selected so as to provide high hardness and outstanding wear resistance to increase the life expectancy of materials that are coated. The use of thermal spray coatings often achieves a reduction in wear and a corresponding increase in part life. The improvement in the wear resistance as a result of the use of a thermal spray coating has also enabled the substitution of cheaper coating materials for fully alloyed parts.

Thermal spray coatings are often applied by a plasma spray gun. Where such coatings are applied to increase wear resistance, wear resistant materials such as tungsten carbide particles are mixed or alloyed with a binding agent. During the spray process, the tungsten carbide particles are exposed to temperatures in excess of 20,000° F. During such thermal exposure, tungsten carbide in the presence of oxygen may be subject to decarburization. In such a reaction, a desirable WC phase is disassociated to form less desirable constituents such as $W_2C$, $CO_2$, free tungsten and carbon. Although $W_2C$ is harder than WC, in most applications $W_2C$ is not a desirable phase due to its brittleness.

The extreme temperatures of a plasma spray gun may promote or accelerate an adverse oxygen reaction in other constituents of thermal spray coatings as well. Examples of these materials include other carbides, diamonds and transition metal nitrides. The end result is a coating with less than optimal intended properties. Accordingly, a need has existed for a method of minimizing the decarburization or other forms of high temperature oxygen related reactions associated with plasma spray coating.

SUMMARY OF THE INVENTION

In accordance with the present invention, a plasma gun used in the method of the present invention includes a cathode, an anode, an arc gas inlet, and two or more injection ports located at different points along the plasma axis. A suitable arc gas is introduced through the arc gas inlet into an open-ended chamber that has the shape of a nozzle and is defined by the boundary of the anode. Ionization of the arc gas between the cathode and the anode forms a plasma that emanates from the open-ended chamber. A coating that is to be deposited upon a part is formed by powdered materials that are injected into the plasma at different points along the plasma axis. For example binder powder is suspended within a carrier gas that is fed into the plasma through a first injection port. A material subject to high temperature oxygen reactions is suspended within the carrier gas that is fed into the plasma flame through a second injection port located further downstream. The materials of the first port and the second port are intermingled within the plasma to form a uniform coating having constituent percentages relating to the powder-feed rates of the materials to the respective ports.

The second injection port leads to and injects the material conveyed therein to a cooler part of the plasma. The positioning of the second injection port is also such that the material injected therein is subject to a shorter dwell time within the plasma flame. The lesser magnitude and duration of the heat reduces high temperature oxygen reactions in those materials that are susceptible to such reactions. Though not mandatory, the second injection port may be located on the exterior of the plasma gun so as to achieve injection into a cooler part of the plasma and a shorter dwell time within the plasma.

The method of the present invention is beneficial when using coating materials such as tungsten carbide, that are subject to decarburization under high temperatures. Other carbides, diamonds, and transition metal nitrides are examples of other materials subject to high temperature oxygen reactions and may be appropriately used in the method of the present invention.

Further objects, features, and advantages of the invention will be apparent from the following detailed description when taken in conjunction with the accompanying drawings.

DESCRIPTION OF THE PREFERRED EMBODIMENT

Figure 1:
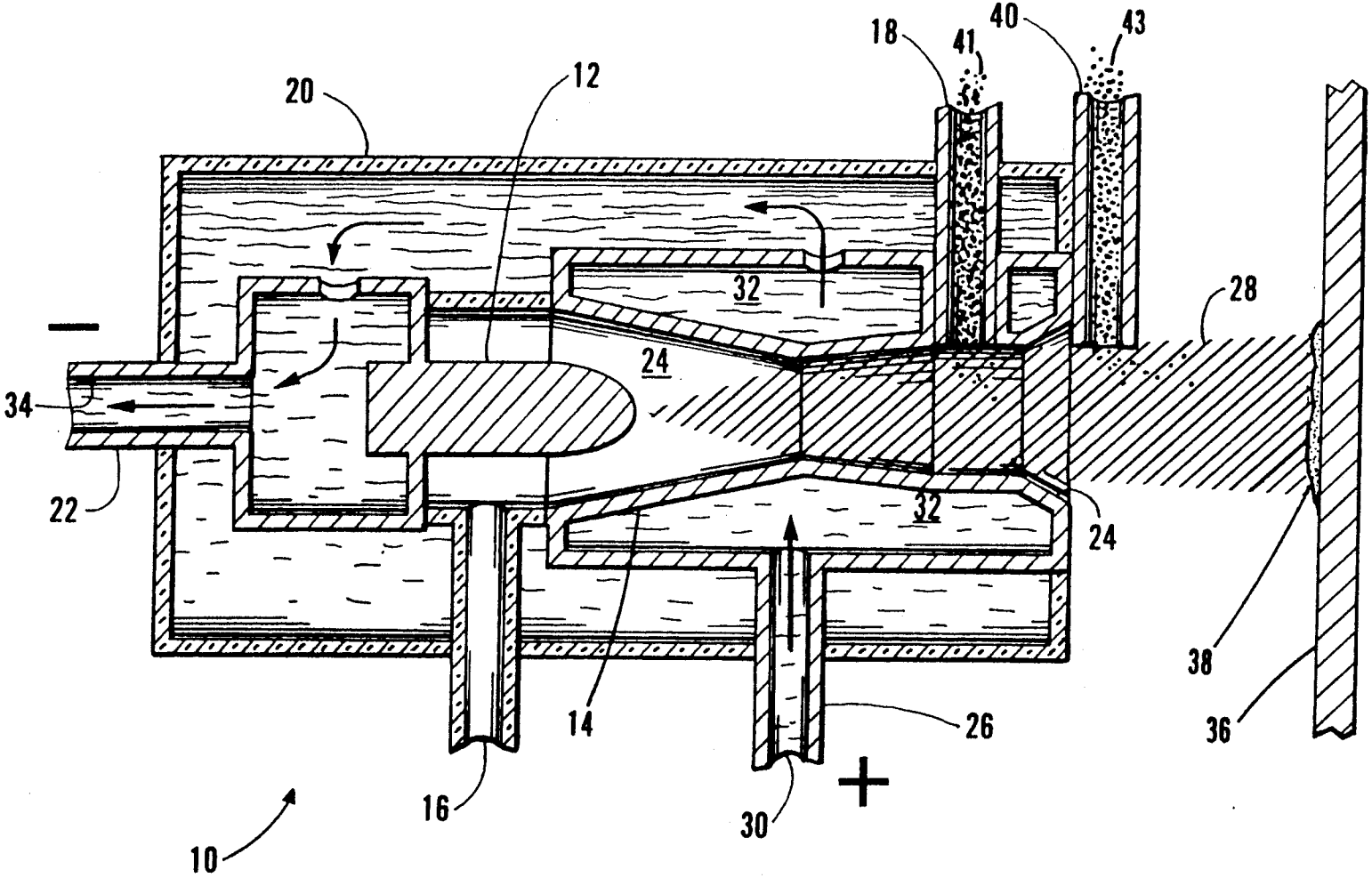
FIG. 1. is a schematic cross-sectional view of a plasma gun suitable for use in the method of the present invention.

Thermal spray coating is a process in which particles are heated to a molten or plastic state and propelled to impinge upon a base metal or other substrate to form a coating. Such coatings may be used in applications for wear and abrasion resistance, electrical and thermal conduction, electrical and thermal resistance, reclamation of worn parts, repair of wrongly machined components, corrosion resistance and for other purposes. Plasma guns used for the deposition of a thermal spray coating are well-known in the art. With reference to FIG. 1, a plasma gun suitable for use in the method of the present invention is represented schematically at 10. The plasma gun 10 comprises a cathode 12, an anode 14, an arc gas inlet 16, and a powder injection Port 18, all parts arranged within an insulating housing 20.

The cathode 12 is usually positioned in the rear of the plasma gun 10, is pointed or conically shaped, and is usually fabricated from tungsten or thoriated tungsten, which has good electron emission characteristics. The cathode 12 is connected to a negative electrical connection 22 and is maintained at a negative electrical potential during operation of the plasma gun 10. The anode 14 is usually positioned as the front electrode in the plasma gun 10, is shaped to define an open-ended chamber 24, and is usually constructed of copper because of its high thermal conductivity. The anode 14 is connected to a positive electrical connection 26 and is maintained at a positive electrical potential during operation of the plasma gun 10.

The arc gas inlet 16 is in communication with the open-ended chamber 24. Upon introduction of a suitable arc gas under pressure into the arc gas inlet 16 and formation of an arc resulting from the electrical current crossing the gap between the cathode 12 and the anode 14, a plasma 28 is formed with a plasma axis running from the cathode 12 to the surface to be coated 36. The cathode 12 represents the upstream direction along the plasma axis and the surface 36 represents the downstream direction. Generally, temperatures within the plasma decrease further downstream along the plasma axis. The plasma 28 results in a zone of intense heat that begins at the tip of the cathode 12 and that extends through and emanates from the open-ended chamber 24. The magnitude of the heat in the plasma flame 28 is dependent on the current applied between the cathode 12 and the anode 14, and the choice of arc gas. Because of the intense heat generated by the plasma gun 10, the parts are water-cooled. Water enters through a water inlet 30, flows through a passageway 32 in the anode 14 and, is routed through the housing 20, and exits at a water outlet 34.

Figure 2:
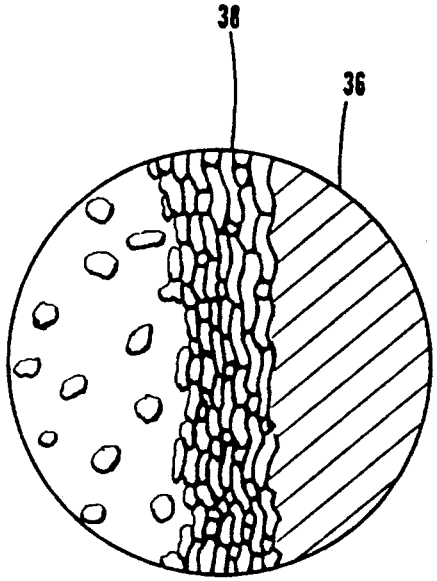
FIG. 2. is a cross-sectional view of a material treated by the method of this invention showing a magnification of the deposition upon the substrate to form a coating.

The coating 38, shown in FIG. 2, is formed from a material in powder form that is metered by a powder feeder or hopper (not shown) and introduced into a suitable carrier gas that suspends and feeds the material to the plasma 28 through the powder injection port 18. The plasma 28 heats the powder into a molten or semi-molten state and the powder is propelled to impinge upon a base metal part 36 to form a coating 38 thereon. The open-ended chamber 24 is shaped as a nozzle through which the plasma 28 and molten material contained therein is projected onto the base metal part 36. Depending on the powder that is used to form the coating 38, the heat of the plasma 28 is adjusted accordingly so that the heat is sufficient to melt the powder into an appropriately molten or plastic state. A bond is then produced at the interface between the base metal part 36 and the coating 38. FIG. 2 is a magnification of this interface, showing deposition of the coating upon the base metal part.

In producing a coating 38 upon a base metal part 36, operating conditions are controlled by instruments that control power level between the cathode 12 and the anode 14, pressure and flow rate of the arc gas, flow rate of the carrier gas, powder-feed rate (quantity of powder introduced into the arc per unit time), and cooling water flow.

Where a constituent of the powder that forms the coating 38 is susceptible to an adverse oxygen reaction that degrades the quality of the coating 38 somewhat, the extreme heat of the plasma flame 28 may cause problems in that it may promote or accelerate the oxygen reactions. An example is the use of tungsten carbide as a constituent in the powder to form a wear-resistant coating. During thermal exposure, the tungsten carbide may be converted from a desirable WC phase to $W_2C$ and $CO_2$. $W_2C$ is not a desirable phase due to its brittleness. Materials other than tungsten carbide that are applied as coatings in thermal spray coating processes and that are subject to high temperature oxygen reactions have similar difficulties.

In the method of the present invention, a second powder injection port located downstream of the first port 40 is employed. In the first powder injection port 18, a binder powder 41 carried in a carrier gas is injected into the plasma 28. In the second powder injection port 40, the material subject to degradation by adverse high temperature oxygen reactions 43 is fed into the plasma 28. The second injection port 40 is located downstream so as to inject or feed the material transported therein into a cooler portion of the plasma 28. Further, the dwell time, in the plasma 28, of the material injected through the second injection port 40 is less than that for the material injected through the first injection port 18. Both the degree of heat and the time exposed to the heat is therefore reduced for that material that is injected into the plasma 28 via the second injection port 40. The method of the present invention therefore minimizes decarburization or other adverse oxygen reactions of injected material.

The material injected into the first injection port 18 and the material injected into the second injection port 40 intermingle within the plasma flame 28 to form a uniform coating 38 having constituent percentages related to the powder-feed rates of the materials through the respective ports 18 and 40. If the powder subject to high temperature oxygen reactions is injected by itself at port 40 and no powder is injected at port 18 a highly porous poor quality coating will result.

EXAMPLE

A coating powder containing 11% Chromium, 0.45% Carbon, 4% Silicon, 3% Iron, 2.4% Boron, and the balance Nickel, and having a particle-size range −44 microns +10 microns (i.e. the largest particles have a diameter of 44 microns and the smallest are 10 microns), was internally injected into a plasmadyne SG-100 plasma gun equipped with a Mach 1 anode such as is schematically represented in FIG. 1. The powder was injected at 12.4 grams/minute and sprayed at 32.4 kW of D/C powder. Simultaneously, a coating powder containing 88% WC, 12% cobalt, and size distribution of −44 microns +10 microns was externally injected into the plasma. The carbide powder was injected at 19.9 grams/minute. The resultant coating contained approximately 60% by weight carbide alloy and the balance Nickel Chromium based alloy.

The concentrations of the different materials injected at the first and second ports 18 and 40 may be altered by changing the powder-feed rates of the first and second ports 18 and 40. For specialized applications, it is also possible to vary the powder feed rate during the deposition process to vary the concentrations at different portions of the coating.

The second injection port 40 as shown in FIG. 1 is located outside the housing 20, though this does not necessarily have to be the case. The second injection port 40 may also be located within the housing 20, or both injection ports may be located outside the housing, so long as the second port is positioned to expose the material carried therein to a location within the plasma 28 so as to reduce the effects of the extreme heat promoted oxygen reactions. The distance between the ports 18, 40, as well as the relative locations of the ports 18, 40 will be subject to variation due to the nature of the plasma 28 produced and the characteristics of the material that form the coating. For example, if the binder material that is fed into the first injection port 18 is a ceramic, the plasma 28 is necessarily hotter to melt the ceramic. For such an application, the injection port 40 would need to be positioned further away from the first injection port 18 than for other material combinations. As noted above, when tungsten carbide is heated excessively in the presence of oxygen decarburization occurs in which a desirable WC phase is converted to a $W_2C$ phase and other less desirable phases. Tungsten carbide is an example of a material that would be introduced via the second injection port 40. Other carbides, diamond and transition metal nitrides are examples of other materials in which it would be expected that exposure to a lesser heat through the second injection port 40 would result in an improved coating 38 due to reduced high temperature oxygen reactions.

It should be understood that a port may be comprised of a manifold around the axis of the plasma gun with a multiplicity of ports in the plane of the manifold for injecting material into the plasma.

It is to be understood that the invention is not confined to the particular method herein illustrated and described, but embraces such modifications thereof as come within the scope of the following claims.

We claim:

1. A method for minimizing the decarburization of tungsten carbide in the application of a thermal spray coating upon a base material part by a plasma gun, the gun having a cathode, an anode and arc gas flowing from the cathode to the anode, the method comprising the steps of:

(a) producing a plasma and directing the plasma through a chamber to emanate from the gun;

(b) feeding a binder material into the plasma;

(c) feeding tungsten carbide in the form of particles contained in a metallic matrix into the plasma at a separate point of entry downstream from that of the binder material such that the tungsten carbide is fed to a cooler portion of the plasma and the dwell time for the tungsten carbide within the plasma is less than that of the binder material, wherein the tungsten carbide and binder material intermingle within the plasma; and (d) simultaneously depositing the intermingled tungsten carbide and binder material from the plasma to produce a coating upon the base material part.

2. The method of claim 1 wherein the binder material is fed into the plasma through a first port spaced from the cathode and the tungsten carbide is fed into the plasma through a second port further spaced from the cathode.

3. The method of claim 2 wherein a plasma is formed between the cathode and the anode which defines an axis of the plasma and wherein the binder material is fed into the plasma through a first manifold around the axis of the plasma and in a plane substantially perpendicular to the axis and spaced from the cathode, the binder material being fed through a multiplicity of injection ports int eh manifold into the plasma, and wherein the tungsten carbide is fed into the plasma through a second manifold around the axis of the plasma in a plane substantially perpendicular to the axis which is spaced from the first manifold away from the direction of the cathode, the tungsten carbide being fed into the plasma through a multiplicity of injection ports in the manifold.

4. The method of claim 1 wherein the binder material is in a molten state and the tungsten carbide is in a plastic state when the binder material and the tungsten carbide are deposited from the plasma.

5. The method of claim 1 wherein the feed rate of either or both of the binder material or the tungsten carbide is varied to alter the concentration of the different materials upon the base material part that are deposited from the plasma gun.

6. The method of claim 4 wherein the concentration of tungsten carbide is altered at different regions throughout the coating of the same base metal part.

* * * * *